US007252131B2

(12) United States Patent
Draghetti et al.

(10) Patent No.: US 7,252,131 B2
(45) Date of Patent: Aug. 7, 2007

(54) UNIT FOR APPLYING PRINTED SLIPS TO PACKETS IN PACKAGING MACHINES

(75) Inventors: Fiorenzo Draghetti, Medicina (IT); Andrea Biondi, Bologna (IT)

(73) Assignee: G.D S.p.A., Bologna (IT)

( * ) Notice: Subject to any disclaimer, the term of this patent is extended or adjusted under 35 U.S.C. 154(b) by 317 days.

(21) Appl. No.: 10/158,061

(22) Filed: May 31, 2002

(65) Prior Publication Data

US 2002/0185232 A1 Dec. 12, 2002

(30) Foreign Application Priority Data

Jun. 6, 2001 (IT) ..... BO2001A0360

(51) Int. Cl.
*B65C 1/04* (2006.01)
*B65C 1/06* (2006.01)

(52) U.S. Cl. ..... 156/566

(58) Field of Classification Search ..... 156/539, 156/542, 556, 559, 560, 561, 564, DIG. 1, 156/DIG. 2, DIG. 3, DIG. 4
See application file for complete search history.

(56) References Cited

U.S. PATENT DOCUMENTS

| | | | | |
|---|---|---|---|---|
| 3,865,671 | A * | 2/1975 | Kronsder | 156/488 |
| 4,293,365 | A * | 10/1981 | Geyser et al. | 156/364 |
| 4,489,631 | A | 12/1984 | Seragnoli et al. | |
| 4,578,133 | A * | 3/1986 | Oshefsky et al. | 156/164 |
| 4,605,459 | A * | 8/1986 | Voltmer et al. | 156/215 |
| 4,812,195 | A * | 3/1989 | Vijuk | 156/357 |
| 4,876,839 | A * | 10/1989 | Honda et al. | 53/136.3 |
| 5,019,207 | A | 5/1991 | McCoy | |
| 5,024,348 | A * | 6/1991 | Kronseder | 221/11 |
| 5,111,633 | A * | 5/1992 | Draghetti | 53/136.1 |
| 5,203,953 | A | 4/1993 | Focke et al. | |
| 5,645,680 | A * | 7/1997 | Rietheimer | 156/567 |
| 5,775,062 | A | 7/1998 | Ghini et al. | |
| 6,009,926 | A * | 1/2000 | Vicktorius et al. | 156/556 |
| 6,598,647 | B1 * | 7/2003 | Draghetti | 156/566 |
| 2002/0056257 | A1 * | 5/2002 | Deutsch et al. | 53/415 |
| 2004/0088949 | A1 * | 5/2004 | Deutsch et al. | 53/136.1 |

FOREIGN PATENT DOCUMENTS

| | | |
|---|---|---|
| EP | 0370633 | 5/1990 |
| EP | 1097871 | 5/2001 |
| WO | 9928195 | 6/1999 |

* cited by examiner

*Primary Examiner*—George Koch
(74) *Attorney, Agent, or Firm*—Timothy J. Klima

(57) ABSTRACT

Printed slips are applied to packets in a cigarette packer by a unit comprising a first device designed to feed slips procured as single items and ordered in a stack, or a second device designed to feed slips obtainable as cuts generated from a continuous strip; the two feed devices are conceived as mutually interchangeable accessory components that can be mounted in identical manner to a universal pickup and application device that is installed permanently in the machine and able to take up the slips with equal facility from either the first or the second feed device at a pickup station.

9 Claims, 6 Drawing Sheets

UNIT FOR APPLYING PRINTED SLIPS TO PACKETS IN PACKAGING MACHINES

BACKGROUND OF THE INVENTION

The present invention relates to a unit intended for the application of printed slips to packets in packaging machines.

In particular, and to advantage, the invention finds application in machines for manufacturing packets of cigarettes, the field to which reference is made explicitly in the following specification albeit with no limitation implied, whilst the term "printed slip" is used to indicate a coupon, plain or folded, or a label or revenue stamp, of the kind typically associated with such packets.

Printed slips of the type in question are in most cases either cut from a continuous strip or drawn from a stack of diecuts. The machines by which the slips are applied will obviously be equipped with different feed devices according to the manner in which the slips are procured. In the case of folded coupons, in particular, these can be cut from a continuous strip folded previously along one or more longitudinal crease lines and decoiled thus from a roll, or alternately, the folding operation can be carried out at the moment when the strip is decoiled and fed to the machine.

Conventionally, a cigarette packer can be used both for the production of articles furnished with printed slips cut from a continuous strip, and for the production of articles furnished with slips procured in the form of diecuts. Obviously, given the high operating speeds and outputs of machines in use today, and the high profitability expected of them, the changeover from one type of production to another on the same packer will be economically justifiable only when the conversion of the machine from the one type of operation to the other can be accomplished in a relatively short time.

The prior art embraces packer machines equipped with devices designed to feed printed slips either from a continuous strip or from the bottom of a vertical magazine, operating in conjunction with respective devices by which the slips are picked up and applied to the packets, wherein the changeover from one type of feed system to another is effected by replacing both the feed and the pickup devices.

As a result, cigarette packers currently in use are rendered less adaptable to different types of slips and to their corresponding feed systems, and consequently less profitable.

The object of the present invention is to provide a unit for the application of printed slips in packaging machines, from which the aforementioned drawbacks can be eliminated.

SUMMARY OF THE INVENTION

The stated object is realized, according to the invention, in a unit for applying printed slips to packets in packaging machines, which comprises first means by which to feed slips procurable as single items and ordered in a stack, or second means by which to feed slips obtainable as cuts made from a continuous strip, and is equipped with a universal pickup and application device installed permanently in the machine, such as will take up the slips with equal facility from either the first or the second feed means at a pickup station.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
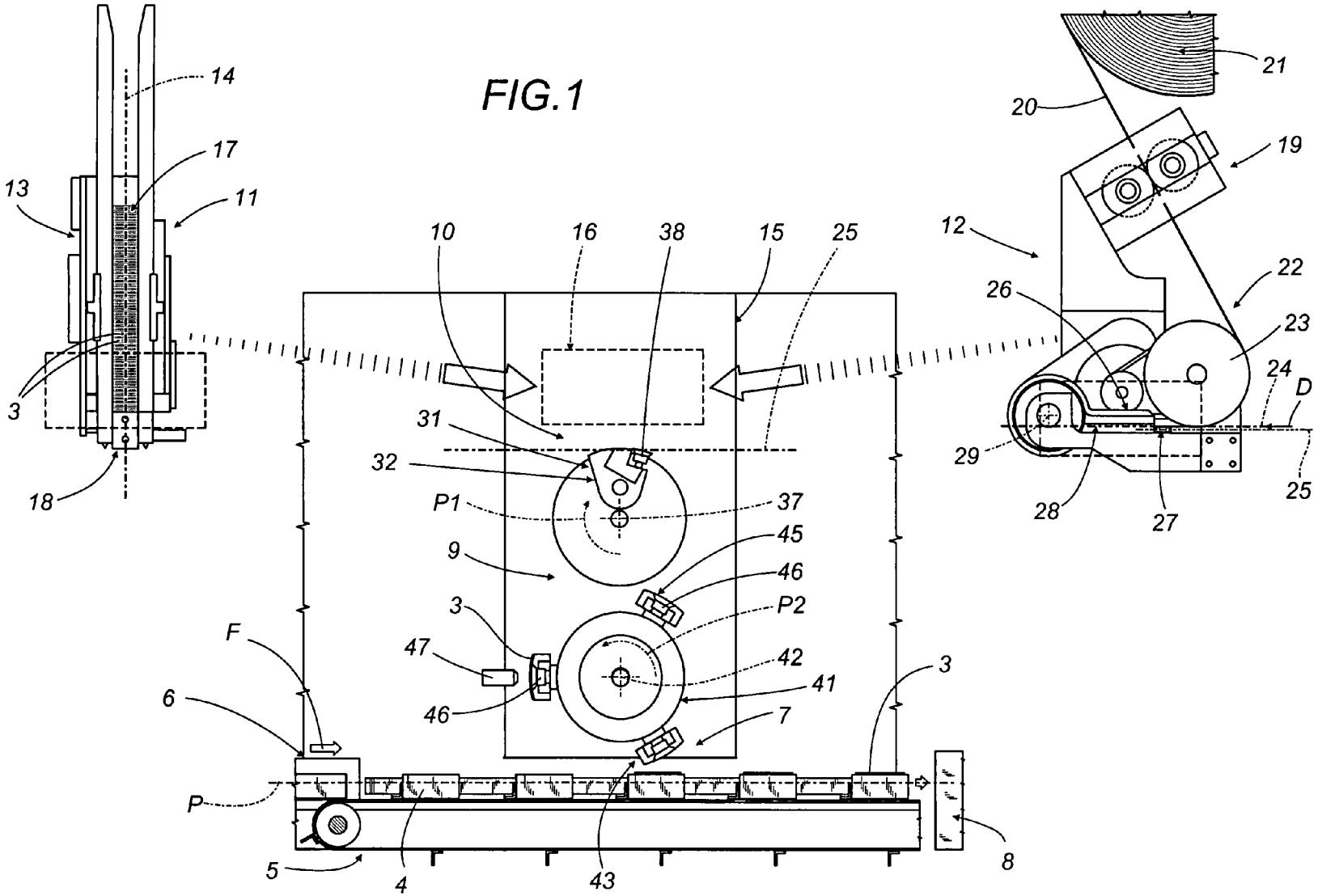
FIG. 1 shows a portion of a packer machine, viewed schematically in elevation with certain parts omitted and comprising a unit for applying printed slips to packets embodied in accordance with the present invention, in which the slips can be supplied by two different and interchangeable feed devices.

Referring to FIG. 1 of the drawings, 1 denotes a portion, in its entirety, of a packaging machine, and 2 denotes a unit, likewise in its entirety, for the application of detachable printed slips 3 to packets 4 of substantially parallelepiped shape, for example of the type with a hinged lid.

The portion 1 of the machine is equipped with a conveyor denoted 5 in its entirety, by which the packets 4 are received at an infeed section 6 and advanced in succession along a predetermined feed path P in a given direction F toward a station 7 at which a slip 3 is applied to each packet 4 by the unit 2 aforementioned, and thereafter toward an overwrapping machine represented schematically as a block 8, by which the packets 4 are overwrapped in transparent plastic material (a familiar operation not illustrated in the drawings).

The application unit 2 comprises a pickup and application device denoted 9 in its entirety, which is positioned immediately above the application station 7.

The device 9 is of universal design, installed permanently on the machine in a fixed position, and can be supplied with slips 3 at a pickup station 10 by first feed means 11 or by second feed means 12 consisting respectively in a first feed device 11 or a second feed device 12. The devices 11 and 12 in question are interchangeable accessories, shown schematically in FIG. 1 in positions not as yet fitted to the application unit 2, so as to indicate the facility of using one or other device 11 or 12 according to the requirement.

Figure 2:
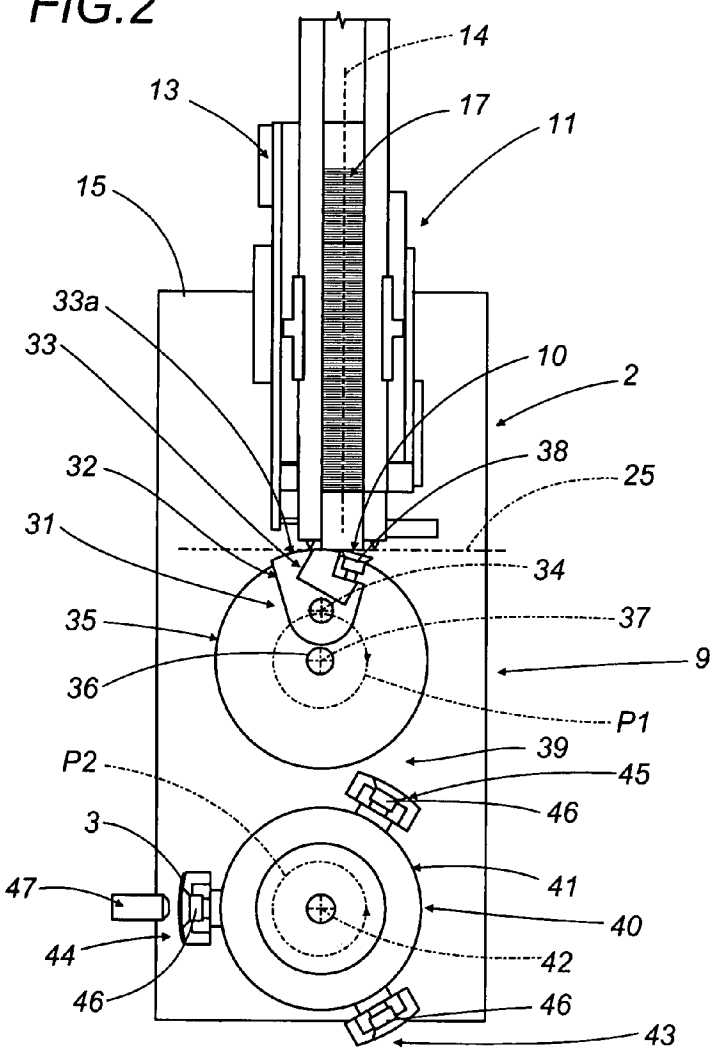
FIG. 2 illustrates the portion of the packer as in FIG. 1, viewed schematically in elevation and with certain parts omitted for clarity, showing the application unit associated with the first device for feeding the printed slips.

Observing FIGS. 1 and 2, the first device 11 for feeding the printed slips 3 will be seen to include a magazine 13 with a substantially vertical axis 14 positionable on a vertical bulkhead 15 of the application unit 2, and more exactly fixed to a mounting point 16 indicated by a phantom outline in FIG. 1.

The magazine 13 is designed to hold a stack 17 of slips 3 removable one by one from a bottom end 18 of the selfsame magazine when fixed to the mounting point 16 and positioned thus with the bottom end 18 facing the pickup station 10.

Figure 3:
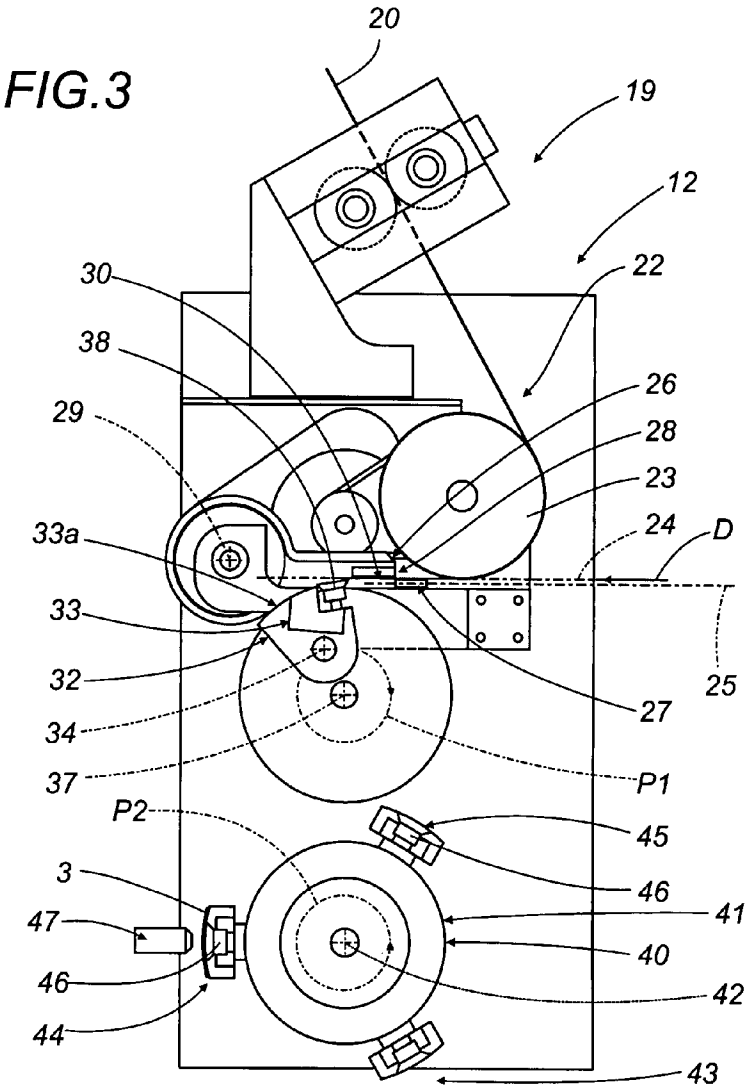
FIG. 3 illustrates the portion of the packer as in FIG. 1, viewed schematically in elevation and with certain parts omitted for clarity, showing the application unit associated with the second device for feeding the printed slips.

Observing FIGS. 1 and 3, the second device 12 for feeding the printed slips 3 will be seen to include a decoiling unit 19 by which a continuous strip 20 of material is drawn from a roll 21, and a feed unit 22 comprising a suction roller 23 located downstream of the decoiling unit 19, in relation to the direction of the running strip 20, by which the selfsame strip 20 is diverted along a substantially horizontal direction D coinciding with a plane 24 that lies parallel with and in close proximity to a reference plane 25 of the pickup station 10

Importantly, it will be observed also that the position of the reference plane 25 relative to the pickup station 10 remains the same in the event of the first feed device 11 being utilized.

The second device 12 further comprises a cutter unit 26 presenting a fixed blade 27 and a movable blade 28, positioned in sequence along the feed direction D followed by the advancing strip 20, respectively below and above the plane 24 occupied by the strip 20.

Figure 4:
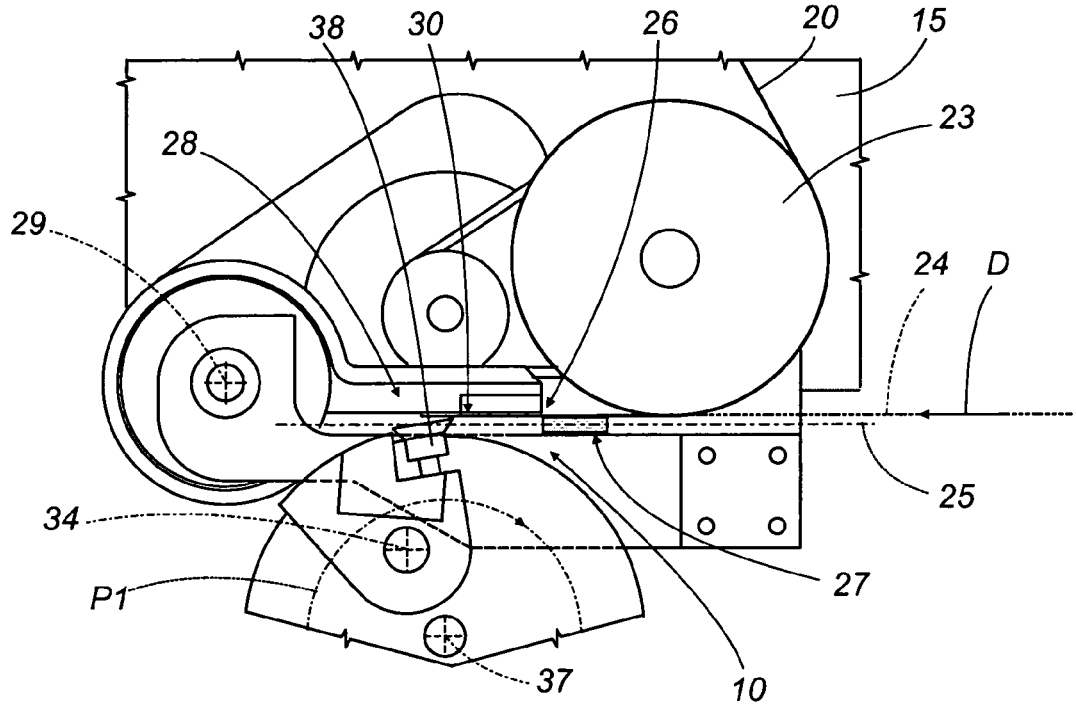
FIGS. 4 and 5 show a detail of the second feed device in two different operating steps, viewed in elevation.
Figure 5:
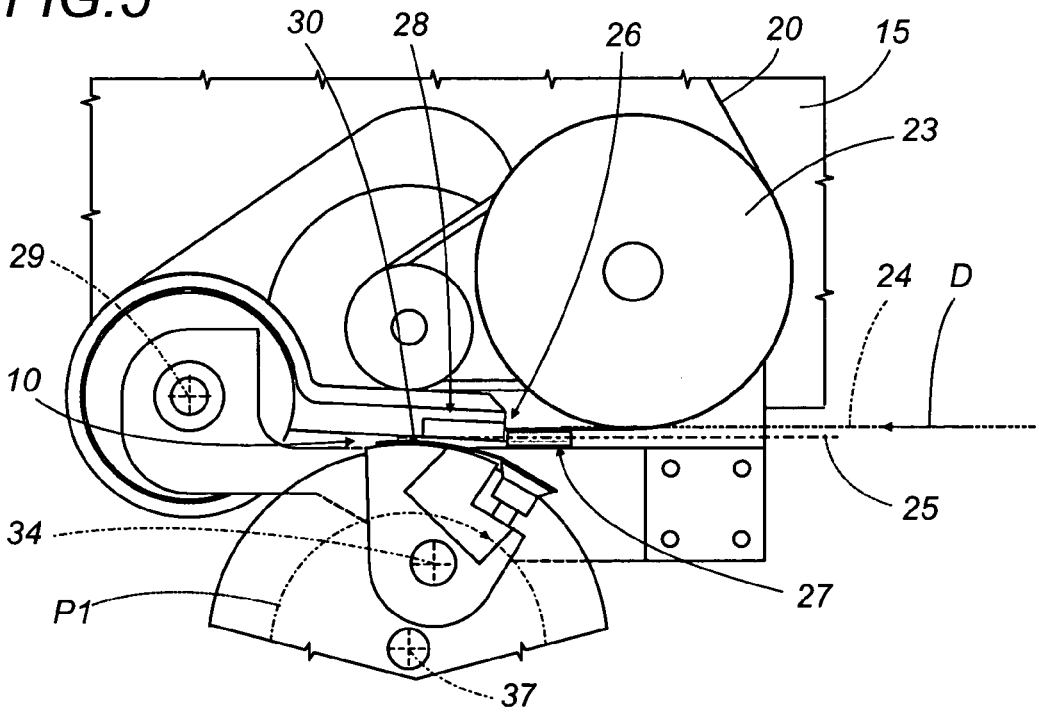

The movable blade 28 of the cutter unit 26 is pivotable about an axis 29 normal to the vertical bulkhead 15 between a raised non operating position indicated in FIG. 4, distanced from the plane 24 and affording a passage to a portion 30 of the strip 20 indexed forward by the suction roller 23, and a lowered operating position of interaction with the fixed blade 27, indicated in FIG. 5, in which the aforementioned portion 30 of strip 20 constituting one slip 3 is cut and transferred into a position occupying the same plane as the pickup station 10.

With reference to FIGS. 1, 2, 3, 7 and 8, the aforementioned pickup and application device 2 includes a pickup assembly 31 of the type disclosed in U.S. Pat. No. 5,775,062, to which reference may be made for a full description. Such an assembly 31 comprises at least one pickup mechanism 32 with an aspirating sector 33 having a cylindrical outer pickup surface 33*a* centered on an axis 34 normal to the vertical bulkhead 15, which is designed to pick up a single slip 3 from the first feed device 11 or alternatively from the second feed device 12, at a point coinciding with the reference plane 25 of the pickup station 10. The pickup mechanism 32 is made to advance at constant speed along a predetermined path P1, through the agency of a carrier device 35 mounted to a power driven shaft 36 of which the axis is denoted 37. The mechanism 32 comprises a plurality of suction cups 38 occupying a part of the aspirating sector 33 of the outer surface 33*a*, aligned parallel with the aforementioned axis 34 and connected to a conventional source of negative pressure (not indicated), and able thus to attract and retain a single slip 3 on the surface 33*a*. More exactly, and as described in U.S. Pat. No. 5,775,062, the pickup mechanism 32 is caused to rotate about the axis 37 of the carrier device 35 in such a way that the outer surface 33*a* rolls tangentially to the reference place 25 of the pickup station 10, engaging progressively in contact with a slip 3 positioned at the bottom end 18 of the magazine 13 or under the movable blade 28 of the cutter unit 26 when in the lowered operating position. Thus, the suction cups 38 make contact by degrees with the slip 3, which is transferred gradually away from the station 10.

Thereafter, the mechanism 32 is advanced by the carrier device 35 along the aforementioned path P1, moving clockwise as viewed in the drawing, toward a release position 39.

The unit 2 disclosed also presents an application assembly 40 located below the pickup assembly 31, interposed between the latter assembly 31 and the conveyor 5. This further assembly 40 operates in conjunction with the pickup assembly 31 and is equipped with a drum 41 rotatable about an axis 42 parallel to the axis 37 of the pickup assembly 31 between the release position 3 and a position 43, coinciding with the application station 7, in which a slip 3 is applied to the relative packet 4. The drum 41 carries three angularly equidistant second pickup mechanisms 44, pneumatic in operation, which as discernible in FIGS. 2, 3, 7 and 8 comprise a cylindrical surface 45 concentric with the axis 42 of rotation, and two suction cups 46 positioned one on either side of the surface 45, connected to a source of negative pressure not illustrated in the drawings.

The second pickup mechanisms 44 are designed to interact with the aspirating sector 33 of the first pickup mechanism 32 at the release position 39, where the slips 3 are transferred from the suction cups 38 of the first mechanism 32 to the suction cups 46 of the second mechanisms 44.

During the course of the transfer, the suction cups 38 and 46 describe a rolling movement relative to the slip 3, devoid of sliding contact not least by virtue of their elastic deformability, and are also offset one from the another rather than being mutually opposed.

More particularly, the drum 41 rotates about its axis 42 in a counterclockwise direction, as viewed in the drawing, in such a manner as to transfer the slips 3 along a path P2 tangential to the path P followed by the packets 4 on the conveyor 5 and affix one slip 3 to a corresponding face of each packet 4 at the application station 7, at least one dab of adhesive having been deposited on the slip 3 by a gumming device 47 positioned along the path P2 followed by the mechanisms 44 (see FIG. 1).

Figure 9:
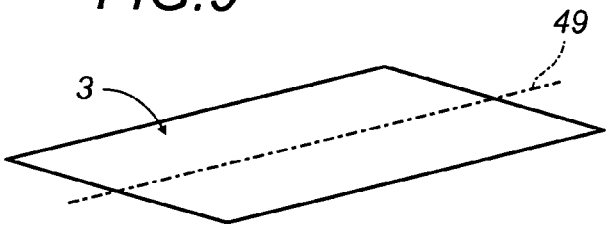
FIGS. 9, 10 and 11 illustrate three different types of printed slip, viewed in perspective.
Figure 10:
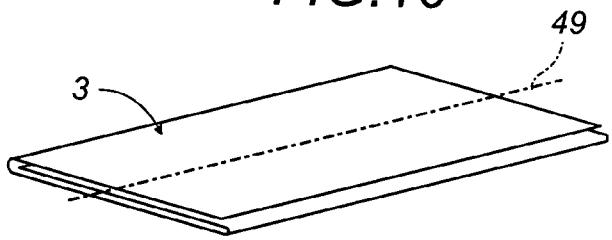
Figure 11:
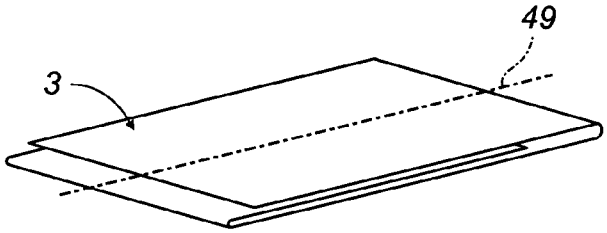
Figure 12:
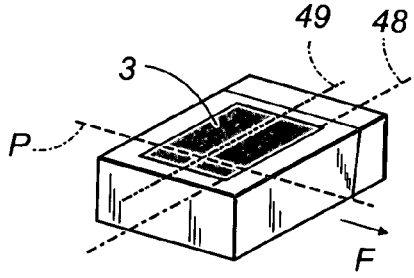
FIG. 12 is the enlarged perspective view of a packet furnished with a printed slip.

As discernible in FIGS. 1 and 12, the packets 4 lie flat on the conveyor 5 as they proceed along the feed path P, advancing with their longitudinal axes 48 set transversely to the feed direction F, whilst the printed slips 3, which in FIGS. 9, 10 and 11 appear substantially rectangular and are referable to a relative longitudinal axis 49, are applied to the packets 4 each with the longitudinal axis 49 parallel to the longitudinal axis 48 of the packet 4.

Assuming that the slips 3, whether picked up from the magazine 13 by the first feed device 11 or cut from a strip 20 and picked up consequently by the second feed device 12, are directed into the pickup station 10 with their longitudinal axes 49 disposed parallel to the axes 49 of the packets 4 advancing along the conveyor 5, then the subsequent transfer of each slip 3 from the pickup station 10 to the application station 7 can be effected without any need for a change of orientation.

Conversely, in the event that the slips 3 enter the pickup station 10 with their respective axes 49 disposed transversely to the longitudinal axes 48 of the packets 4, and therefore parallel to the feed direction F followed by the packets 4 on the conveyor 5, then the orientation must be changed during the passage from the pickup station 10 to the application station 7 in order to bring the axes 49 into a position substantially of parallel alignment with the axes 48 of the single packets 4.

Figure 6:
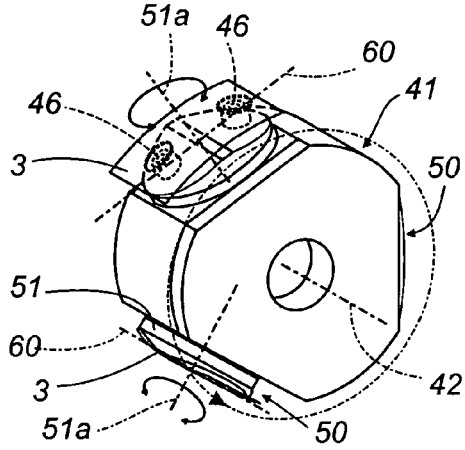
FIG. 6 shows a detail of the unit of FIG. 1, illustrated in an alternative embodiment and viewed in perspective.

To this end, the drum 41 can be equipped as in the alternative embodiment of FIG. 6 with three angularly equidistant second pickup mechanisms 50, pneumatic in operation and comprising two suction cups 46 similarly to the first mechanisms 44, but differing from the first in that they are mounted to respective shafts 51 rotatable about respective radial axes 51*a* through the agency of conventional mechanical linkages (not illustrated) in such a way as to maneuver the suction cups 46 from a position of alignment on a line 60 parallel to the transfer path P2 to a position in which the selfsame line 60 is disposed transversely to the transfer path P2, thereby rotating the slips 3 through 90°.

This would be the procedure in case of the slip 3 illustrated in FIG. 10, which is folded along crease lines extending parallel to the longitudinal axis 49 and cut from a continuous strip 20 along lines transverse to the selfsame axis 49.

Figure 8:
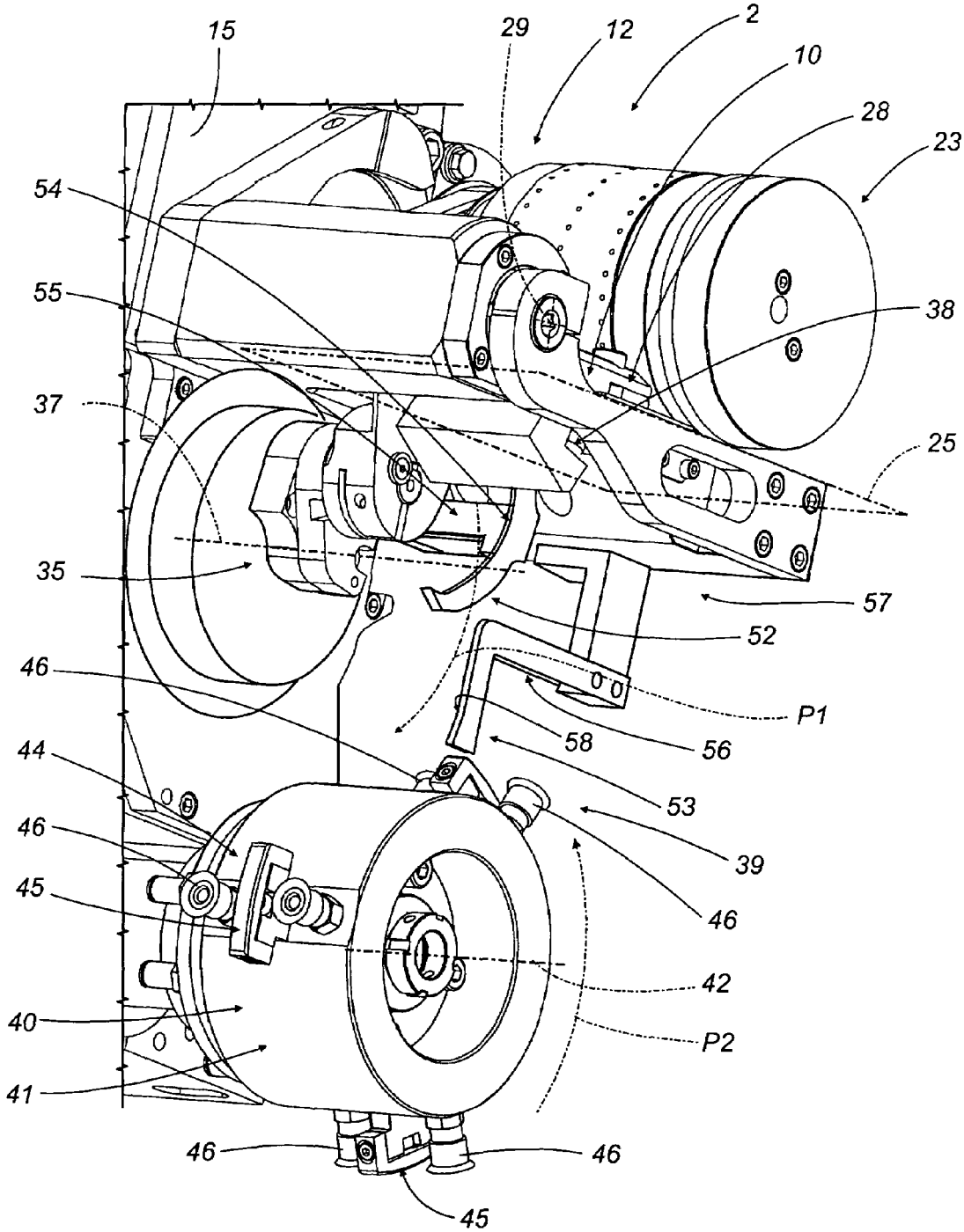

In the case of the slip 3 shown in FIG. 11, which is folded along crease lines transverse to the longitudinal axis 49 and for example cut from a strip 20 along lines parallel to the axis 49, or cut previously and stacked in a magazine 13, the orientation of the axes 49 on entering the pickup station 10 will be transverse to the feed path P1 and thus parallel to the axes 48 of the packets 4; in this instance the unit 2 comprises first and second guiding and locating means 52 and 53, as illustrated in FIG. 8, positioned between the pickup station 10 and the release position 39, serving to ensure that the folded slips 3 are transferred correctly.

In particular, the first such guide means 52 comprise an arcuate element 54 associated with the end of a bracket 55 rigidly attached to the carrier device 35 and designed to prevent the overlapping leaves of the folded slip 3 from opening out and becoming detached, whilst the second guide means 53 comprise an L-shaped plate 56 fixed at one end to the frame 57 of the relative feed device 11 or 12.

The plate 56 in question presents a free end 58 disposed parallel to the feed path P1, of which the function is to prevent relative movement between the overlapping leaves of the folded slip 3.

It will be observed that the second vacuum pickup mechanisms 50 might be mounted permanently to the second pickup assembly 40 and activated only when effectively necessary for the reasons indicated.

Figure 7:
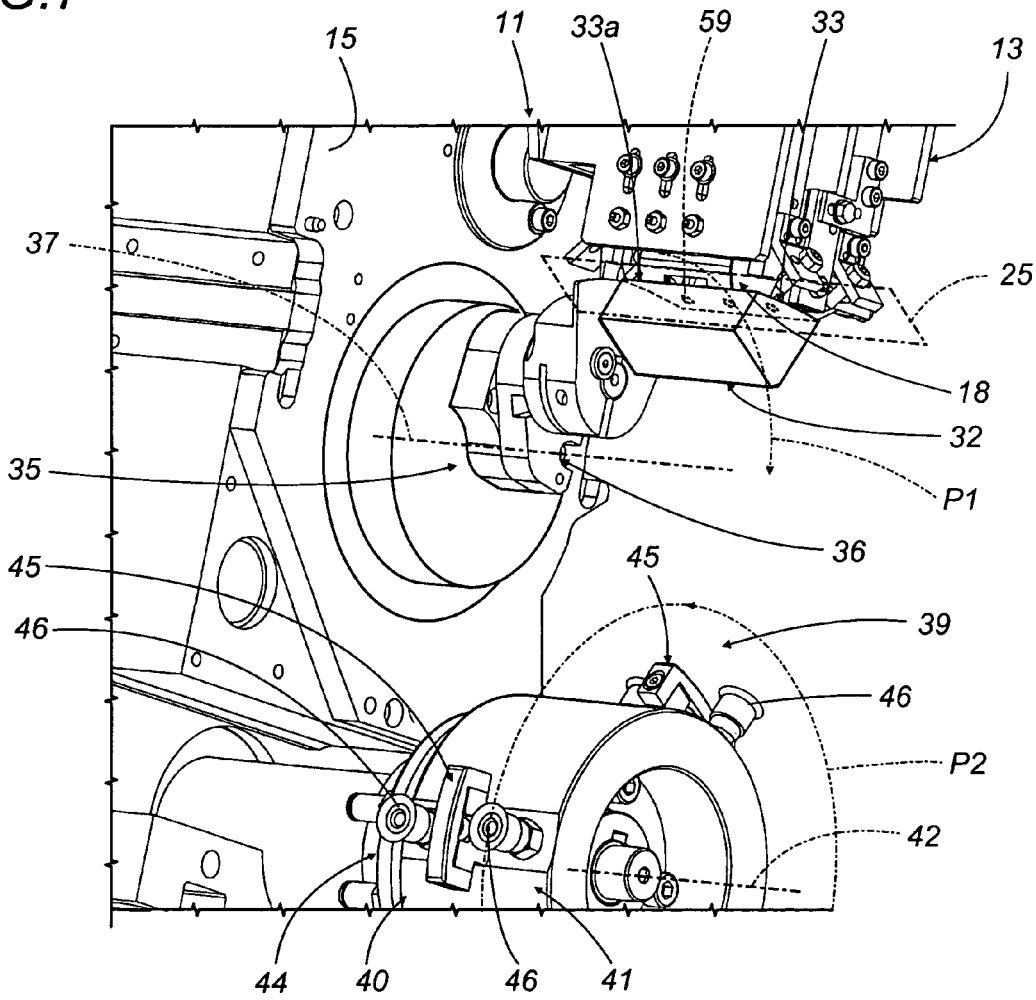
FIGS. 7 and 8 show part of the unit of FIG. 1 associated respectively with the first and with the second device for feeding the printed slips, viewed in perspective.

In addition, the aspirating sector 33 of the first pickup assembly 31 might present a plurality of holes 59 rather than suction cups 38, as in the example of FIG. 7, connected likewise to a source of negative pressure (not illustrated).

What is claimed is:

1. A unit for applying printed slips to packets in packaging machines, comprising one of first means by which to feed slips procured as single items ordered in a stack, or second means by which to feed slips obtainable as cuts made from a continuous strip, and a universal pickup and application device installed permanently in the machine such as will take up the slips with equal facility from either the first or the second feed means at a pickup station, wherein the first and second feed means are mutually interchangeable one with the other to feed the universal pickup and application device, said first or second feed means being fixable on one mounting point of the universal pickup and application device;

said pickup and application device including: at least one pickup assembly capable of movement between the pickup station and a release position about an axis lying parallel to a reference plane of the pickup station; and an application assembly operating in conjunction with the pickup assembly, rotatable about a respective axis extending parallel to the axis of rotation of the pickup assembly and capable of movement thus between the release position and a position at which a slip is applied to a respective packet;

said pickup and application device comprising first and second guiding and locating means serving to ensure the correct transfer of the slips; said first guiding and locating means comprising an arcuate element operating in conjunction with the pickup assembly and said second guiding and locating means comprising an L-shaped plate operating in conjunction with the application assembly.

2. A unit as in claim 1, wherein first feed means comprise a magazine containing a plurality of slips ordered in a stack aligned on a relative axis substantially perpendicular to the pickup station.

3. A unit as in claim 1, wherein second feed means comprise units by means of which respectively to decoil, feed and cut a continuous strip, of which the feed unit is designed to Index the continuous strip, at least when in the neighborhood of the pickup station, through predetermined steps and in a direction coinciding with a plane disposed parallel and in close proximity to a reference plane of the pickup station.

4. A unit as in claim 1, wherein the pickup assembly comprises a pickup mechanism which is caused to rotate tangentially to a reference plane of the pickup station during the step of picking up the slips from the selfsame station and thereafter to advance along the predetermined path, passing from the pickup station to the release position.

5. A unit as in claim 4, wherein the pickup mechanism comprises at least one aspirating sector affording a pickup surface of arcuate profile positioned to roll against the reference plane of the pickup station and furnished with a plurality of holes connectable to a source of negative pressure.

6. A unit as in claim 4, wherein the pickup mechanism is furnished with at least one suction cup connectable to a source of negative pressure and designed to attract a slip occupying the reference plane of the pickup station by rolling against one face thereof.

7. A unit as in claim 1, wherein the application assembly comprises second pneumatic pickup mechanisms equidistanced angularly about the axis of rotation of the selfsame application assembly and operating in conjunction with a pickup mechanism of the pickup assembly, by which the slips are transferred along a predetermined path from the pickup assembly to the packets.

8. A unit as in claim 7, comprising gumming means positioned along the transfer path in such a way as to apply an adhesive material to one surface of the slips.

9. A unit as claim 7, wherein the second pickup mechanisms are carried by a drum rotatable about the axis of the application assembly, mounted to respective shafts rotatable in their turn about respective axes disposed transversely to the axis of rotation of the drum in order to change the orientation of the slips during the rotation of the drum.

* * * * *